US008858407B2

(12) United States Patent
Thompson

(10) Patent No.: US 8,858,407 B2
(45) Date of Patent: Oct. 14, 2014

(54) ATHLETE TRAINING DEVICE AND METHOD

(75) Inventor: Matt Thompson, Marietta, GA (US)

(73) Assignee: Speed Tracs America LLC, Marietta, GA (US)

( * ) Notice: Subject to any disclaimer, the term of this patent is extended or adjusted under 35 U.S.C. 154(b) by 276 days.

(21) Appl. No.: 13/418,769

(22) Filed: Mar. 13, 2012

(65) Prior Publication Data

US 2013/0244840 A1 Sep. 19, 2013

(51) Int. Cl.
*A63B 21/00* (2006.01)

(52) U.S. Cl.
USPC ..... 482/121; 482/51; 482/130; 482/142; 482/52

(58) Field of Classification Search
USPC ..... 482/121, 126, 51, 52, 148, 49, 130, 142
See application file for complete search history.

(56) References Cited

U.S. PATENT DOCUMENTS

| | | | | |
|---|---|---|---|---|
| D255,372 | S | 6/1980 | Tidmore | |
| 4,848,741 | A * | 7/1989 | Hermanson | 482/121 |
| 4,863,163 | A | 9/1989 | Wehrell | |
| 4,968,028 | A * | 11/1990 | Wehrell | 482/124 |
| 5,429,567 | A | 7/1995 | Gerschefske et al. | |
| 6,579,197 | B2 | 6/2003 | Renoit | |
| 6,988,285 | B1 | 1/2006 | Sewell | |
| 7,431,681 | B1 | 10/2008 | St. Cyr | |
| 7,494,453 | B2 | 2/2009 | Wehrell | |
| 7,625,320 | B2 | 12/2009 | Wehrell | |
| 7,651,450 | B2 | 1/2010 | Wehrell | |
| 2005/0059537 | A1 | 3/2005 | Hull | |
| 2006/0062413 | A1 | 3/2006 | Wehrell | |
| 2007/0232461 | A1 | 10/2007 | Jenkins et al. | |
| 2010/0130338 | A1 | 5/2010 | Wehrell | |
| 2010/0197462 | A1 | 8/2010 | Piane, Jr. | |

* cited by examiner

*Primary Examiner* — Jerome W Donnelly
(74) *Attorney, Agent, or Firm* — Bryan W. Bockhop; Bockhop & Associates, LLC

(57) ABSTRACT

An athlete training apparatus includes a platform, a force redirecting device that is mounted on the platform, an elastic member, a first user coupler and a second user coupler. The elastic member has a first end and an opposite second end and is engaged with the force redirecting device. The first user coupler is coupled to the first end of the elastic member and is also configured to be worn by a first individual. The second user coupler is coupled to the second end of the elastic member and is configured to be worn by a second individual. When the first individual stands in the standing area and when the second individual applies a force to the elastic member, the force redirecting device redirects a portion of the force to the second user coupler so that a force having a downward vertical component is applied to the first individual.

19 Claims, 3 Drawing Sheets

ATHLETE TRAINING DEVICE AND METHOD

BACKGROUND OF THE INVENTION

1. Field of the Invention

The present invention relates to training devices for athletes and, more specifically, to an athlete training device configured to train more than one athlete.

2. Description of the Related Art

Sports teams employ a variety of devices for training their athletes. Such devices can include weight sets, treadmills, jumping trainers and the like. Most current systems are designed to train single athletes. However, athletes involved in team sports often find that training together often results in better inter-athlete coordination and cooperation. Also, most training devices of the type employed by sports teams tend to be bulky and expensive.

Therefore, there is a need for an athlete training device and method that is inexpensive and that fosters coordination and cooperation between more than one athlete.

SUMMARY OF THE INVENTION

The disadvantages of the prior art are overcome by the present invention which, in one aspect, is an athlete training apparatus that includes a platform, a force redirecting device, an elastic member, a first user coupler and a second user coupler. The platform defines a standing area. The force redirecting device is mounted on the platform. The elastic member has a first end and an opposite second end and is engaged with the force redirecting device. The first user coupler is configured to be coupled to the first end of the elastic member. The first user coupler is also configured to be worn by a first individual. The second user coupler is configured to be coupled to the second end of the elastic member. The second user coupler is also configured to be worn by a second individual. When the first individual stands in the standing area and when the second individual applies a force to the elastic member, the force redirecting device redirects a portion of the force to the second user coupler so that a force having a downward vertical component is applied to the first individual.

In another aspect, the invention is an apparatus for training athletes that includes a platform, four pulleys, a first elastic cord, a second elastic cord, a first belt and a second belt. The four pulleys are spaced apart from each other along different vertices of a rectangle projected onto the platform and are disposition so as to define a standing area therein. Each of the pulleys is coupled to the platform. The four pulleys include a first pair of linearly aligned pulleys disposed along a first side of the rectangle and a second pair of linearly aligned pulleys disposed along a second side of the rectangle that is spaced apart from and parallel to the first side of the rectangle. The first elastic cord has a first end and an opposite second end. The first elastic cord is linearly engaged with each of the first set of pulleys. The second elastic cord has a first end and an opposite second end. The second elastic cord is linearly engaged with each of the second set of pulleys. The first belt has a first side and an opposite second side. The first side is configured to be coupled to the first end of the first elastic cord and the second side is configured to be coupled to the first end of the second elastic cord. The first belt is configured to be worn by a first individual. The second belt has a first side and an opposite second side. The first side is configured to be coupled to the second end of the first elastic cord and the second side is configured to be coupled to the second end of the second elastic cord. The second belt is configured to be worn by a second individual. When the first individual stands in the standing area and when the second individual applies a force to the first elastic cord and the second elastic cord, a portion of the force is directed in a downward direction to the first individual.

In yet another aspect, the invention is a method of training athletes, including a first individual and a second individual, in which a first individual is placed on a platform. A first end of a first elastic member is affixed to the first individual and a second end of the first elastic member is affixed to the second individual who is not on the platform. When the second individual performs an exercise that imparts a force to the elastic member, at least a portion of the force is redirected so as to apply a downward force to the first individual through the elastic member.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
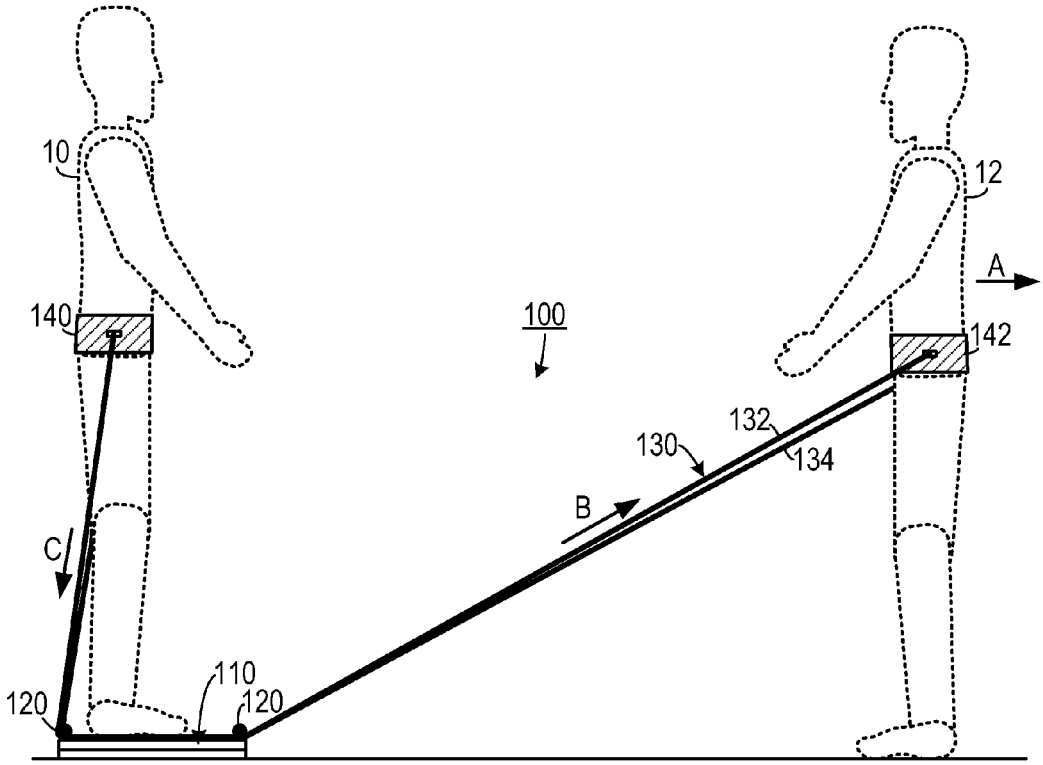
FIG. 1 is a schematic diagram showing a side view of one illustrative embodiment in use.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on."

Figure 2A:
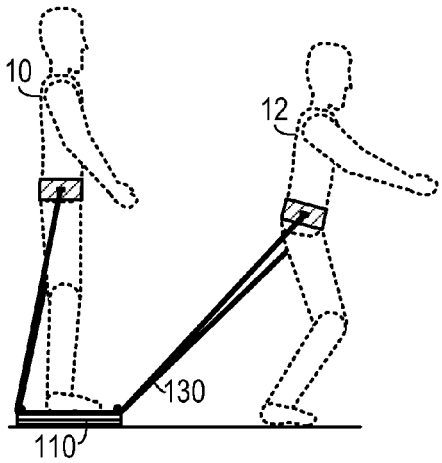
FIGS. 2A and 2B are schematic diagrams showing two athletes employing the embodiment show in FIG. 1 and alternating positions.
Figure 2B:
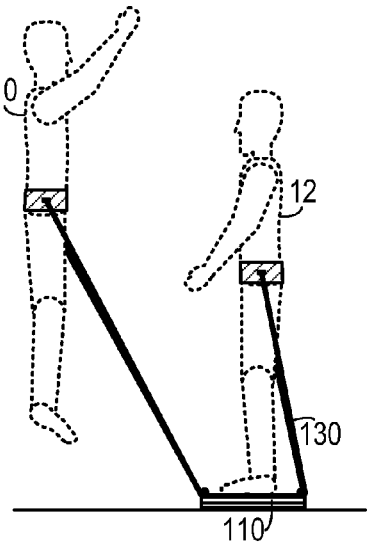
Figure 3:
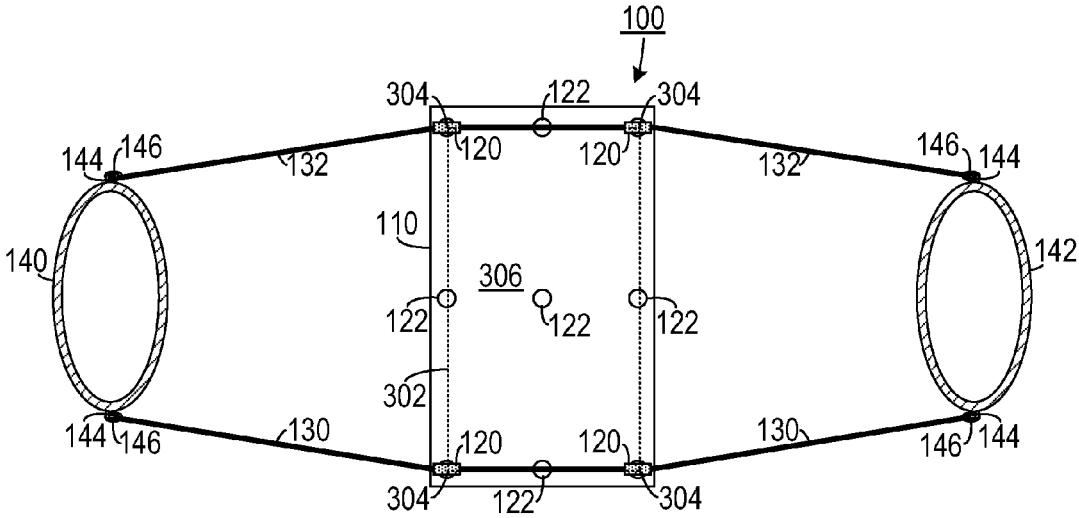
FIG. 3 is a top plan view of one embodiment.

As shown in FIGS. 1-3, one illustrative embodiment is an athlete training device 100 that includes a platform 110 upon which a first athlete 10 may stand. The platform 110 may be mad of many materials, including plastic, wood, metal, or combinations thereof.

Four pulleys 120 that are mounted on the platform 110 engage an elastic member 130. The elastic member 130 can include, for example, a first bungee cord 132 and a second bungee cord 134. (Examples of other types of elastic members that may also be used include: rubber strips enshrouded with fabric; springs, elastic fabric and any other type of elongated elastic material.) The elastic member 130 is coupled at a first end to a first user coupler 140 and at the opposite second end to a second user coupler 142. The first user coupler 140 and the second user coupler 142 can each include a device such as a belt, a harness, or the like. The first user coupler 140 is coupled to the first athlete 10 and the second user coupler 142 is coupled to the second athlete 12.

As shown in FIG. 1, the first athlete 10 stands on the platform 110 while the second athlete 12 performs training exercises. When the second athlete 12 imparts a force on the elastic member 130 in, for example, direction A, a force in direction B is imparted on the platform, but is redirected to a force in direction C that is imparted on the first athlete 10. The presence of the first athlete 10 keeps the platform 110 stable and in position. The first athlete 10 is able to monitor the training of and provide support to the second athlete 12, thereby building a stronger team relationship between the athletes.

As shown in FIG. 1A, a training session might start with the first athlete 10 on the platform 110 while the second athlete 12 performs exercises. After completion of a set of exercises, the positions can switch, as shown in FIG. 2B, and the first athlete 10 will perform the training exercises while the second athlete stands on the platform 110. This position switching can occur repeatedly.

As shown in FIG. 3, the pulleys 120 may be disposed at the vertices 304 of an imaginary rectangle 302 that is projected onto the platform 110, inside of which is a standing area 306. The platform 110 may include a plurality of connection points 122 disposed thereon for connecting pulleys 120 thereto. Each connection point 122 includes a bolt to which a pulley 120 may be affixed. The user couplers 140 and 142 can include a couple of mounted D-rings 144 to which a device 146 can selectively couple the bungee cords 130 and 132. Such a device 146 could be, for example, a carabineer or a spring-loaded clip.

Figure 4:
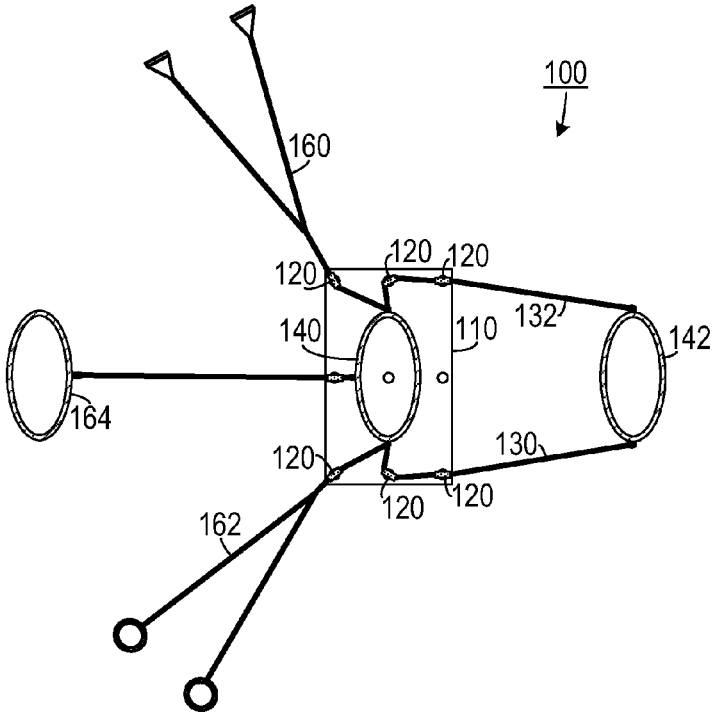
FIG. 4 is a top plan view of an embodiment configured to train more than two athletes simultaneously.

As shown in FIG. 4, more than two athletes can train on the device 100 simultaneously. For example, a first athlete (coupled to the first user coupler 140) could stand on the platform 110 while a second athlete trains as described above. A third athlete could use an elastic upper-body training device 160 that is coupled to the first user coupler 140 through a pulley. A fourth athlete could use an ankle-affixed elastic training device 162 that is coupled to the first user coupler 140 through a pulley. A fifth user could use a waist-affixed elastic training device 164 that is also coupled to the first user coupler 140 through a pulley. In this configuration, if all of the athletes were teamed up in pairs, eight athletes could be assigned to a single device 100 during a training session.

Figure 5:
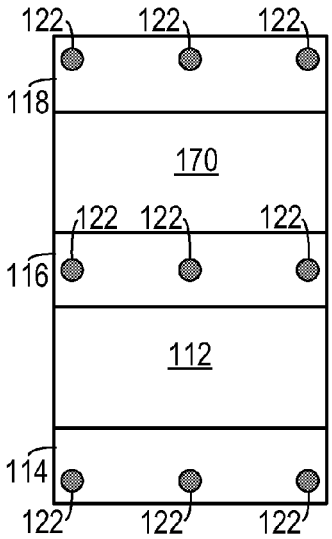
FIG. 5 is a bottom plan view of one embodiment.

As shown in FIG. 5, in one embodiment, the platform 110 includes a rectangular sheet 112 that is reinforced by three spaced support strips 114, 116 and 118 affixed to the bottom side 170 of the rectangular sheet 112 with bolts, which also serve as the connection points 122. Use of the support strips 114, 116 and 118 provides added rigidity to the device and also can set it more firmly in the ground.

Figure 6:
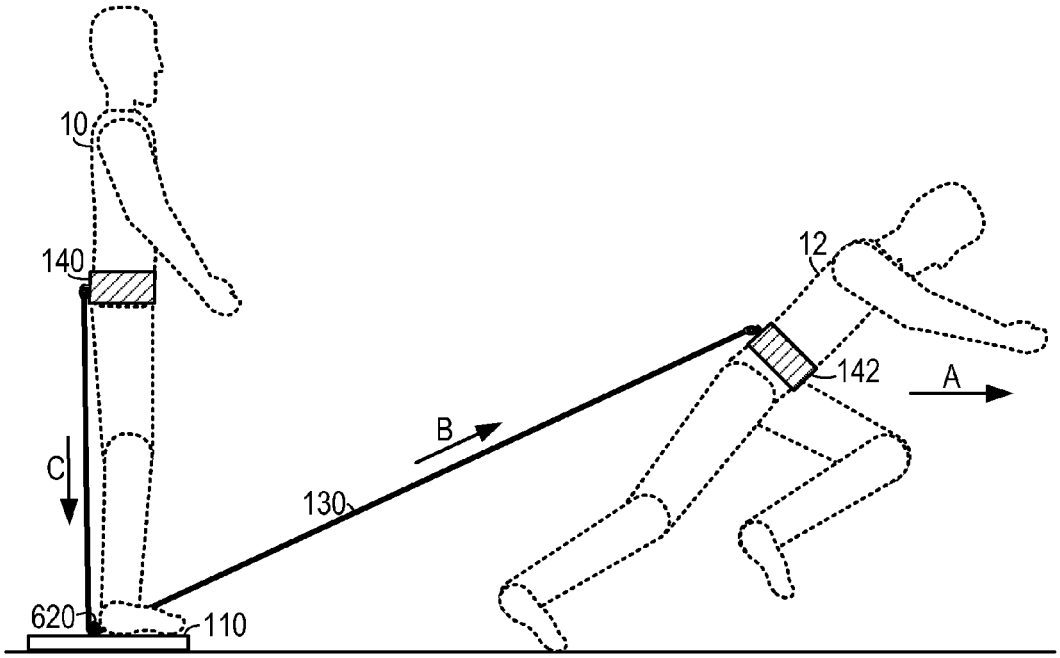
FIG. 6 is a schematic diagram showing an alternate embodiment.

In one simple embodiment, as shown in FIG. 6, a single force redirecting device 620 may be affixed to the platform. The single force redirecting device 620 could include a pulley, or it could be something as simple as an eye bolt or a D-ring. In this embodiment, only as single bungee cord us used as the elastic member 130.

Figure 7:
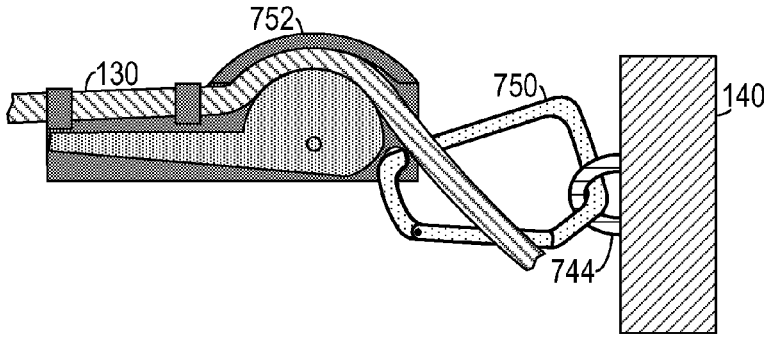
FIG. 7 is a schematic diagram showing one example of a mechanism that is configured to facilitate adjusting elastic member tension.

The tension on the bungee cords can be adjusted simply by tightening them and then tying them in a knot around the D-ring attached to the user coupler belt. In another embodiment, as shown in FIG. 7, the elastic member 130 can be passed through a clamping mechanism 752, which is then used to hold the elastic member 130 in place once it is at the desired tension. The clamping mechanism 752 may be coupled to a D-ring 744 that is affixed to the user coupler 140 by using a carabineer 750 or a similar device. Many other tensioning devices may be employed.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. An athlete training apparatus, comprising:

(a) a platform defining a standing area;

(b) a force redirecting device mounted on the platform;

(c) an elastic member having a first end and an opposite second end and engaged with the force redirecting device, wherein the elastic member comprises two spaced apart elastic cords, each elastic cord including a first end and an opposite second end, the first end of each cord affixed to a different side of the first user coupler, the second end of each cord affixed to a different side of the second user coupler;

(d) a first user coupler configured to be coupled to the first end of the elastic member, the first user coupler configured to be worn by a first individual; and (e) a second user coupler configured to be coupled to the second end of the elastic member, the second user coupler configured to be worn by a second individual, so that when the first individual stands in the standing area and when the second individual applies a force to the elastic member, the force redirecting device redirects a portion of the force to the second user coupler so that a force having a downward vertical component is applied to the first individual.

2. The athlete training apparatus of claim 1, wherein the force redirecting device comprises at least one pulley.

3. The athlete training apparatus of claim 2, wherein the force redirecting device further comprises three additional pulleys, wherein each pulley is disposed at a different vertex of a rectangle projected onto the platform, the standing area defined inside the rectangle.

4. The athlete training apparatus of claim 3, wherein the elastic member comprises two spaced apart elastic cords, each elastic cord including a first end and an opposite second end, the first end of each cord affixed to a different side of the first user coupler, the second end of each cord affixed to a different side of the second user coupler, a first one of the two spaced apart elastic cords engaged with a first pair of the pulleys aligned along a first common side of the rectangle and a second one of the two spaced apart elastic cords engaged with a second pair of the pulleys aligned along a second common side of the rectangle opposite from the first common side.

5. The athlete training apparatus of claim 1, wherein the platform comprises:

(a) a rectangular sheet having a top side, an opposite bottom side, a first end and an opposite second end; and (b) at least three rectangular strips that are evenly spaced apart from each other and affixed to the bottom side, the three rectangular strips including a first strip disposed adjacent to the first end of the rectangular sheet, a second strip disposed adjacent to the second end of the rectangular sheet and a third strip disposed therebetween.

6. The athlete training apparatus of claim 5, wherein the rectangular sheet and the rectangular strips each comprise a plastic.

7. The athlete training apparatus of claim 1, further comprising an elastic training device affixed to the platform, the elastic training device configured to allow at least a third individual to perform an exercise using the elastic training device while the first individual is standing on the platform.

8. The athlete training apparatus of claim 1, further comprising a mechanism configured to allow adjustment of tension on the elastic member.

9. An apparatus for training athletes, comprising:

(a) a platform;

(b) four pulleys spaced apart from each other along different vertices of a rectangle projected onto the platform and disposition so as to define a standing area therein, each of the pulleys coupled to the platform, the four pulleys including a first pair of linearly aligned pulleys disposed along a first side of the rectangle and a second pair of linearly aligned pulleys disposed along a second side of the rectangle that is spaced apart from and parallel to the first side of the rectangle;

(c) a first elastic cord having a first end and an opposite second end, the first elastic cord linearly engaged with each of the first set of pulleys;

(d) a second elastic cord having a first end and an opposite second end, the second elastic cord linearly engaged with each of the second set of pulleys;

(e) a first belt having a first side and an opposite second side, the first side configured to be coupled to the first end of the first elastic cord and the second side configured to be coupled to the first end of the second elastic cord, the first belt configured to be worn by a first individual; and (f) a second belt having a first side and an opposite second side, the first side configured to be coupled to the second end of the first elastic cord and the second side configured to be coupled to the second end of the second elastic cord, the second belt configured to be worn by a second individual, so that when the first individual stands in the standing area and when the second individual applies a force to the first elastic cord and the second elastic cord, a portion of the force is directed in a downward direction to the first individual.

10. The apparatus of claim 9, further comprising an attachment device affixed to the platform and configured to attach an elastic training device thereto, thereby allowing a third individual to exercise while the second individual performs exercises.

11. The apparatus of claim 9, wherein the platform comprises:

(a) a rectangular sheet having a top side, an opposite bottom side, a first end and an opposite second end; and (b) at least three rectangular strips that are evenly spaced apart from each other and affixed to the bottom side, the three rectangular strips including a first strip disposed adjacent to the first end of the rectangular sheet, a second strip disposed adjacent to the second end of the rectangular sheet and a third strip disposed therebetween.

12. The apparatus of claim 11, wherein the rectangular sheet and the rectangular strips each comprise a material selected from a group consisting of: plastic, wood, metal and combinations thereof.

13. A method of training athletes, including a first individual and a second individual, comprising the steps of:

(a) placing a first individual on a platform;

(b) affixing a first end of a first elastic member to the first individual;

(c) affixing a second end of the first elastic member to the second individual who is not on the platform; and (d) when the second individual performs an exercise that imparts a force to the elastic member, redirecting at least a portion of the force so as to apply a downward force to the first individual through the elastic member.

14. The method of claim 13, wherein the redirecting step comprises routing the first elastic member through a force redirecting device affixed to the platform.

15. The method of claim 14, wherein the elastic member comprises two spaced apart elastic cords in which each elastic cord includes a first end and an opposite second end and wherein the force redirecting device comprises four pulleys each disposed at a different vertex of a rectangle projected onto the platform and further comprising the steps of:

(a) directing a first one of the elastic cords through a first linearly aligned pair of pulleys; and (b) directing a second one of the elastic cords through a second linearly aligned pair of pulleys, wherein the second linearly aligned pair of pulleys spaced apart from and parallel to the first linearly aligned pair of pulleys.

16. The method of claim 15, further comprising the steps of:

(a) coupling a first belt to the first individual;

(b) coupling a second belt to the second individual;

(c) affixing the first end of each cord to a different side of the first belt; and (d) affixing the second end of each cord to a different side of the second belt.

17. The method of claim 13, wherein the platform comprises:

(a) a rectangular sheet having a top side, an opposite bottom side, a first end and an opposite second end; and (b) at least three rectangular strips that are evenly spaced apart from each other and affixed to the bottom side, the three rectangular strips including a first strip disposed adjacent to the first end of the rectangular sheet, a second strip disposed adjacent to the second end of the rectangular sheet and a third strip disposed therebetween.

18. The method of claim 17, wherein the rectangular sheet and the rectangular strips each comprise a material selected from a group consisting of: plastic, wood, metal and combinations thereof.

19. The method of claim 13, further comprising the step of affixing an elastic training device to the platform, thereby allowing at least a third individual to perform an exercise using the elastic training device while the first individual is standing on the platform.

* * * * *